US010450785B2

(12) United States Patent
Osti et al.

(10) Patent No.: US 10,450,785 B2
(45) Date of Patent: Oct. 22, 2019

(54) ANTI-CHUCKING DEVICE FOR A MOTOR VEHICLE CLOSURE

(71) Applicant: FORD GLOBAL TECHNOLOGIES, LLC, Dearborn, MI (US)

(72) Inventors: Reinaldo Osti, Camacari (BR); Farley De Matos Souza, Camaçari (BR)

(73) Assignee: Ford Global Technologies, LLC, Dearborn, MI (US)

( * ) Notice: Subject to any disclaimer, the term of this patent is extended or adjusted under 35 U.S.C. 154(b) by 292 days.

(21) Appl. No.: 15/274,835

(22) Filed: Sep. 23, 2016

(65) Prior Publication Data

US 2018/0087308 A1 Mar. 29, 2018

(51) Int. Cl.
*E05F 5/02* (2006.01)
*E05B 77/38* (2014.01)

(52) U.S. Cl.
CPC ..... *E05F 5/022* (2013.01); *E05B 77/38* (2013.01); *E05Y 2900/546* (2013.01); *E05Y 2900/548* (2013.01); *Y10T 16/629* (2015.01)

(58) Field of Classification Search
CPC ... E05F 5/022; E05F 5/025; E05F 5/02; E05F 7/04; E05B 77/38; E05Y 2900/546; E05Y 2900/548; Y10T 16/61; Y10T 16/628; Y10T 16/6285; Y10T 16/629; B62D 33/037
USPC .... 16/82, 86 R, 86 A, 86 B; 296/76, 193.08, 296/50, 56, 57.1, 146.8; 292/DIG. 15, 292/DIG. 19
See application file for complete search history.

(56) References Cited

U.S. PATENT DOCUMENTS

| | | | | |
|---|---|---|---|---|
| 2,054,449 | A | 9/1936 | Seitz et al. | |
| 5,802,671 | A | 9/1998 | Ikuma | |
| 7,014,258 | B2 * | 3/2006 | Schubring | B60J 5/10 292/216 |
| 7,308,731 | B2 * | 12/2007 | Schubring | E05F 5/022 16/86 R |
| 7,644,973 | B2 | 1/2010 | Carloni et al. | |
| 8,550,508 | B2 * | 10/2013 | Gentile | E05B 17/0037 292/341.15 |
| 2006/0097550 | A1 | 5/2006 | Wang et al. | |
| 2008/0206033 | A1 | 8/2008 | Carloni et al. | |
| 2011/0127781 | A1 * | 6/2011 | Meidinger | E05B 47/0009 292/216 |
| 2011/0198872 | A1 | 8/2011 | Gentile et al. | |

FOREIGN PATENT DOCUMENTS

| | | | |
|---|---|---|---|
| GB | 137140 | A | 1/1920 |
| GB | 298431 | A | 10/1928 |
| GB | 393104 | A | 6/1933 |
| KR | 200237705 | U | 11/2001 |

OTHER PUBLICATIONS

English Machine Translation of KR200237705U.

* cited by examiner

*Primary Examiner* — William L Miller
(74) *Attorney, Agent, or Firm* — Jason Rogers; Vichit Chea; King & Schickli, PLLC

(57) ABSTRACT

An anti-chucking device for a motor vehicle closure includes a wedge and a receiver. That receiver includes (a) a first stopper and a second stopper defining a throat there between and (b) a pop-up mechanism in the throat.

7 Claims, 6 Drawing Sheets

D1 < D2 < D3

ANTI-CHUCKING DEVICE FOR A MOTOR VEHICLE CLOSURE

TECHNICAL FIELD

This document relates generally to the motor vehicle equipment field and, more particularly, to an anti-chucking device for a motor vehicle closure.

BACKGROUND

Many motor vehicles are equipped with a swinging closure such as a lift gate, hatchback, trunk lid or tailgate. Swinging closures of this type require an anti-chucking component in order to reduce dynamic fluttering and overslam energy acquired when the operator closes the closure.

FIG. 1 illustrates a prior art anti-chucking device incorporating a "male" wedge W, that is inverted to the closure, and a "female" striker assembly A including two opposed stops $S_1$, $S_2$. Each stop $S_1$, $S_2$ is biased by a spring P. In this prior art device, the spring-loaded stops $S_1$, $S_2$ are tuned to control both (a) noise, vibration and harshness (NVH) attributes like closing sound quality, squeaks and rattles and (b) body attributes like closing effort. Since the stops $S_1$, $S_2$ are tuned to control both conflicting attributes, the end result must necessarily be a compromise.

This document relates to a new and improved anti-chucking device for a motor vehicle closure that includes a first component, two cooperating stops, that are tuned to control body attributes and a separate pop-up mechanism that is tuned to control NVH attributes. As two different components are provided to control the two different attributes, compromises are reduced and better performance is ensured.

More specifically, NVH performance is improved while at the same time a seemingly conflicting reduction in the closing effort required to close the closure is provided. Advantageously, this is accomplished with a relatively small cost penalty. Accordingly, the anti-chucking device disclosed in this document represents a significant advance in the art.

SUMMARY

In accordance with the purposes and benefits described herein, an anti-chucking device is provided for a motor vehicle closure. That anti-chucking device comprises a wedge and a receiver. The receiver includes (a) a first stopper and a second stopper defining a throat there between and (b) a pop-up mechanism in the throat.

The pop-up mechanism includes a plunger biased by a spring. Further, the pop-up mechanism includes a body and a cover.

The plunger includes a proximal end, a distal end and a retaining ring between the proximal end and the distal end. The cover includes a plunger opening. The distal end of the plunger extends through the plunger opening.

The distal end of the plunger has a first diameter D1, the plunger opening has a second diameter D2 and the retaining ring has a third diameter D3 where D1<D2<D3. Accordingly, the plunger is effectively captured by the body and the cover while the distal end of the plunger freely projects from the cover.

The throat includes a first end and a second end. The receiver includes a bracket holding the first stopper and the second stopper and the pop-up mechanism. The first end of the throat is open to receive the wedge when the closure is closed and the bracket closes the second end of the throat. The first stopper may include a first face and the second stopper may include a second face wherein the first face and the second face are opposed and define sidewalls of the throat between the first end and the second end.

The first face and the second face may converge toward the second end of the throat. Further, the plunger may be oriented in the throat and biased by the spring toward the first end.

The wedge may include a third face, a fourth face and a terminal end between the third face and the fourth face. Further, the third face and the fourth face may converge toward the terminal end. When the closure is closed, the wedge is received in the receiver and the terminal end engages the plunger while the third face is juxtaposed to the first face and the fourth face is juxtaposed to the second face. The first stopper and the second stopper may be made from a resilient polymer material including, but not necessarily limited to polyurethane.

In accordance with an additional aspect, a method is provided of improving the NVH performance and reducing the closing effort of a motor vehicle closure. That method comprises the steps of providing a wedge on a free edge of the motor vehicle closure and receiving the wedge in a throat of a receiver defined between a first stopper and a second stopper while engaging the wedge with a plunger positioned in the throat and adapted to dissipate closing energy of the motor vehicle closure.

The method may further include the step of providing the throat with a first end and a second end wherein the first end is opened to receive the wedge. Further, the method may include the step of providing the first stopper with a first face and the second stopper with a second face wherein the first face and the second face define opposing sides of the throat and the first face and the second face converge toward the second end of the throat. Further, the method may include the step of providing the wedge with a third face and a fourth face wherein the third face and the fourth face converge toward the terminal end of the wedge.

In the following description, there are shown and described several preferred embodiments of the anti-chucking device. As it should be realized, the anti-chucking device is capable of other, different embodiments and its several details are capable of modification in various, obvious aspects all without departing from the anti-chucking device as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the anti-chucking device and together with the description serve to explain certain principles thereof. In the drawing figures.

Figure 3:
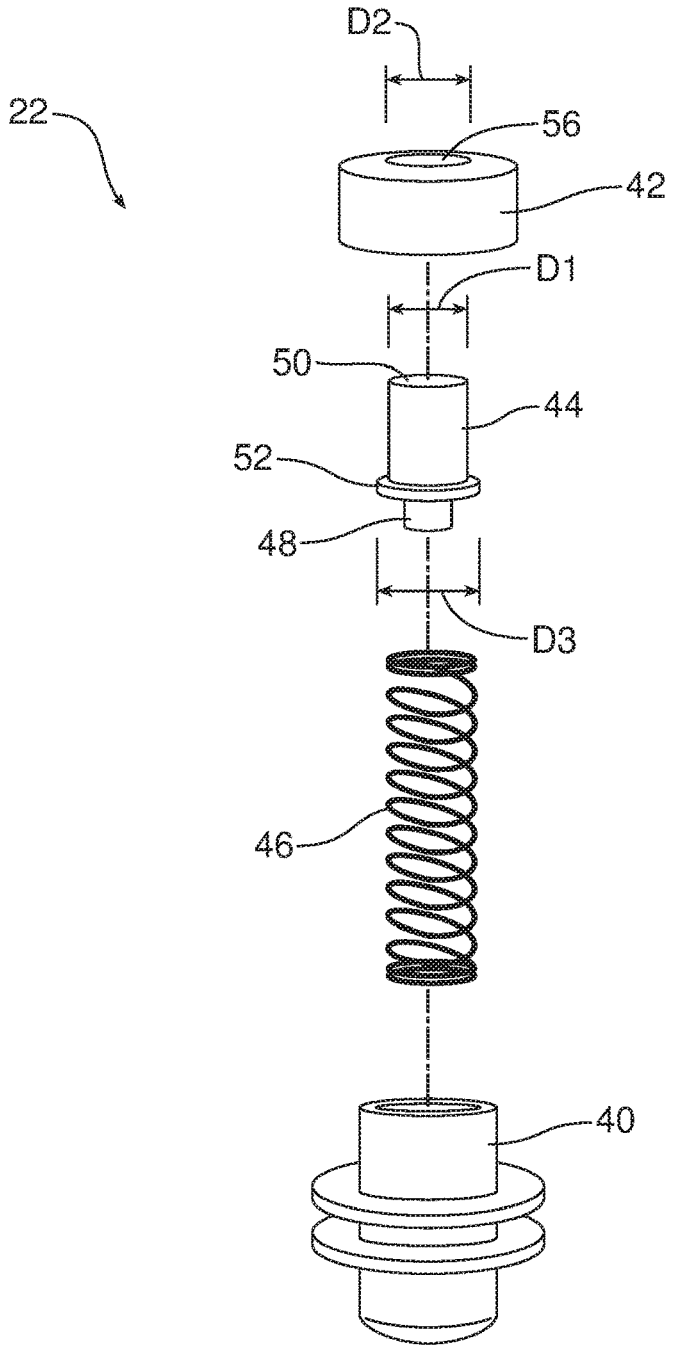
FIG. 3 is a detailed exploded view of the pop-up mechanism of the anti-chucking device illustrated in FIG. 2.
Figure 3A:
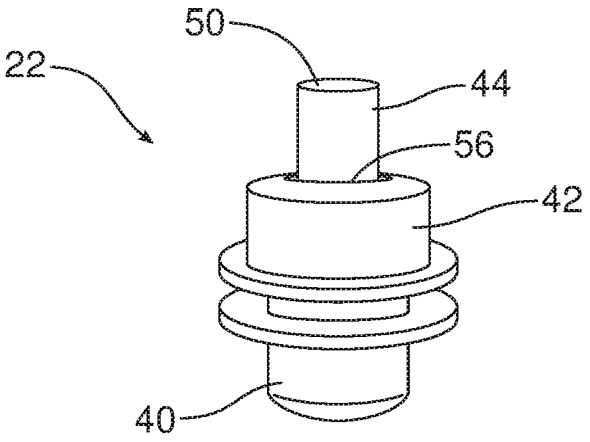

FIG. 3*a* is a detailed cross-sectional view of the assembled pop-up mechanism illustrated in FIG. 3.

Figure 4A:
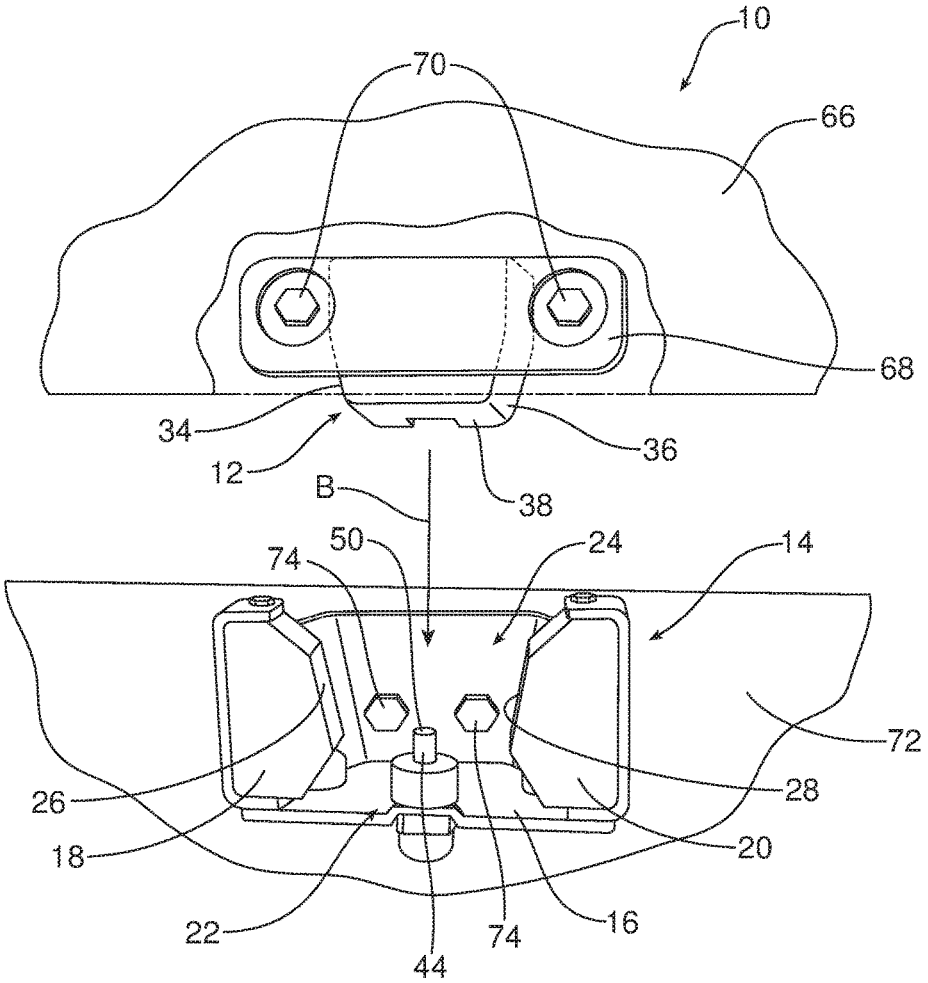
Figure 4B:
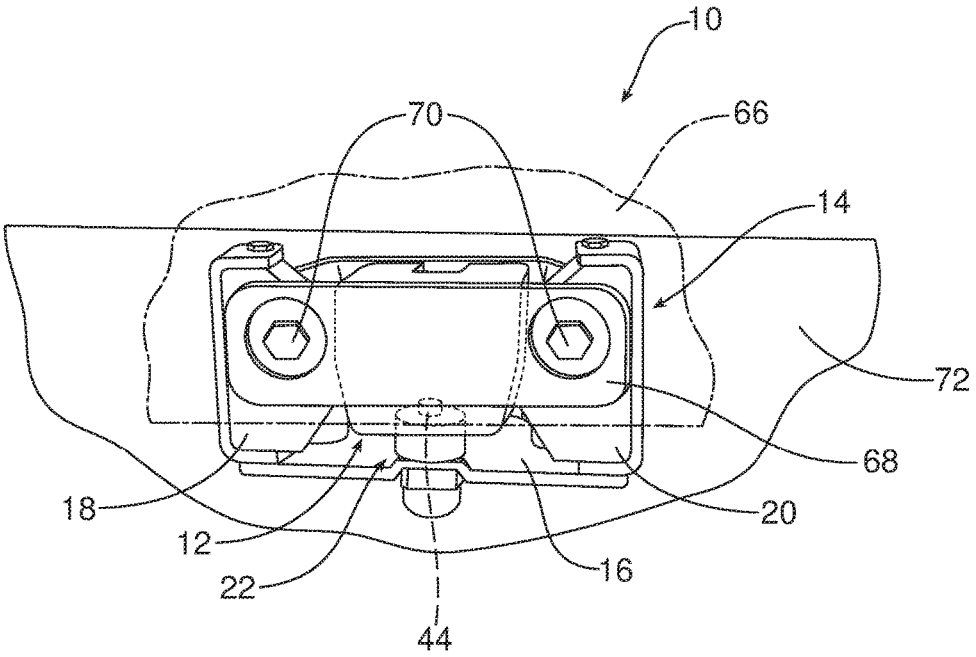

FIGS. 4*a* and 4*b* illustrate the anti-chucking device in respective closure open and closure closed positions.

Reference will now be made in detail to the present preferred embodiments of the anti-chucking device, an example which is illustrated in the accompanying drawing figures.

DETAILED DESCRIPTION

Figure 1:
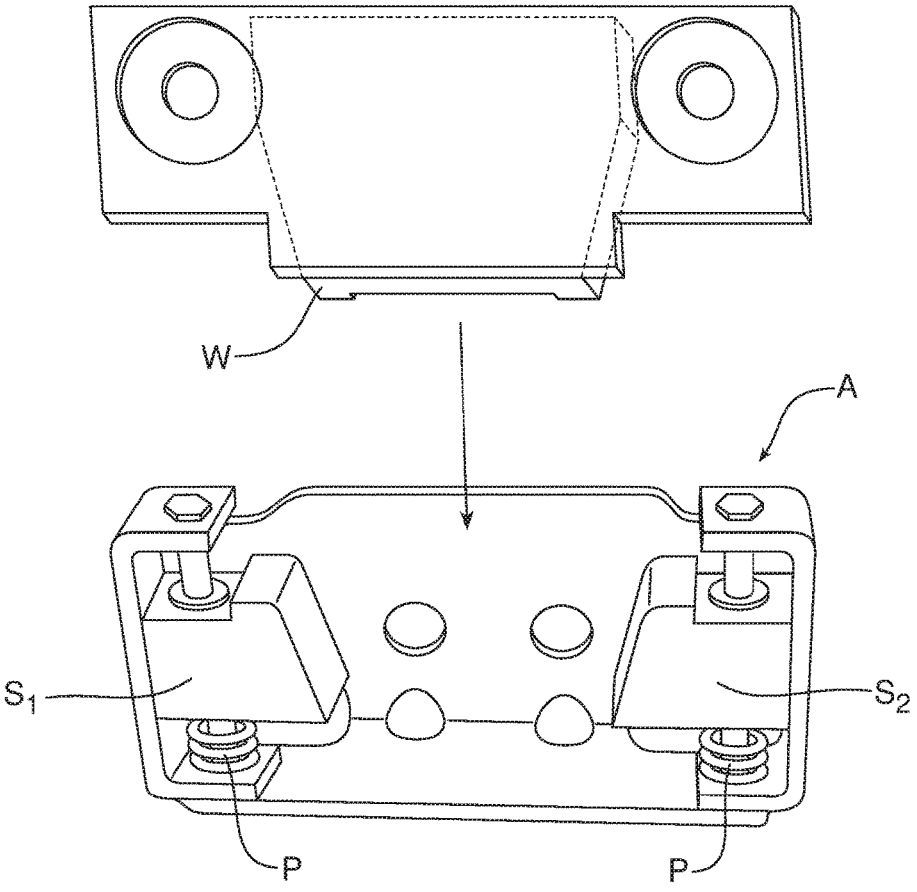
FIG. 1 PRIOR ART
FIG. 1 is an illustration of a prior art closure device including a wedge carried on the closure and a cooperating striker assembly carried on the body panel of the motor vehicle.
Figure 2:
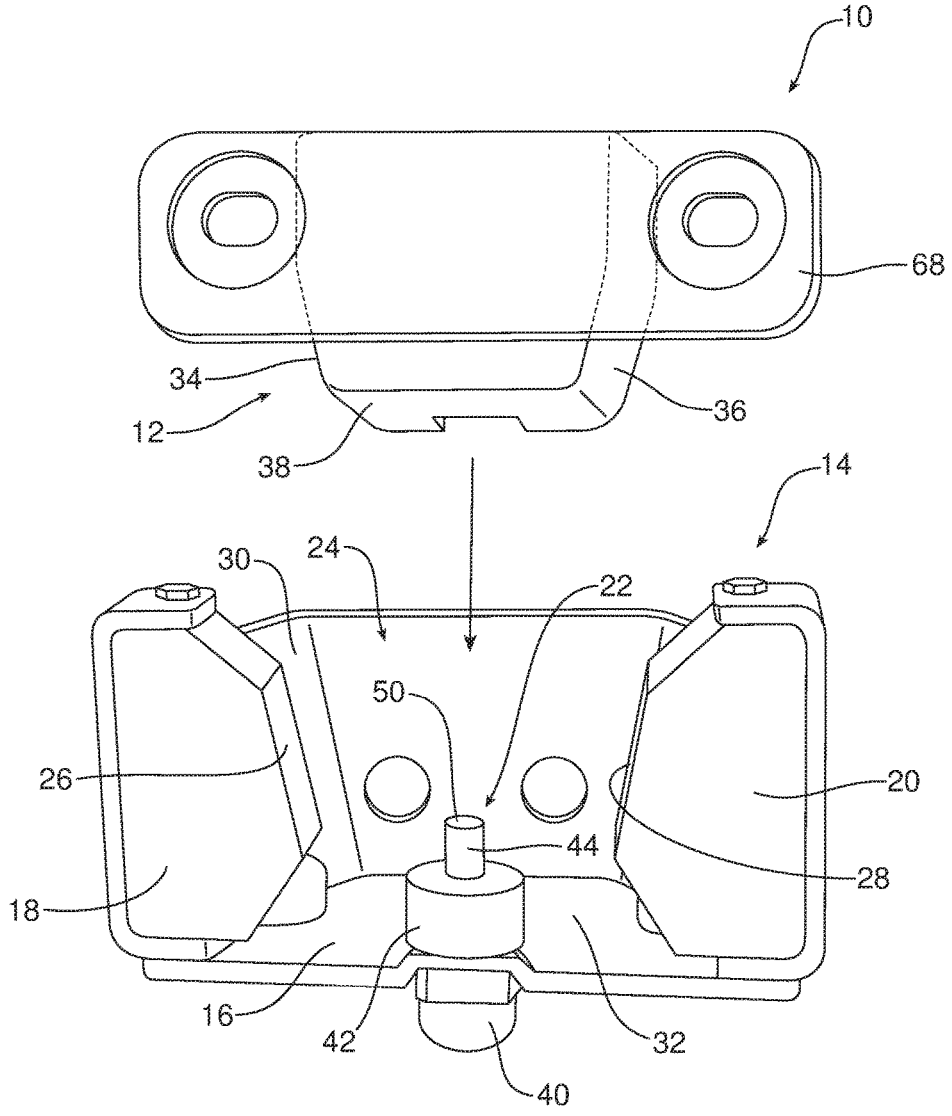
FIG. 2 is a plan view of the new and improved anti-chucking device for a motor vehicle closure illustrating the wedge and receiver.

Reference is now made to FIG. 2 illustrating the new and improved anti-chucking device 10 adapted for a motor vehicle closure including, particularly, any swinging closure such as a lift gate, tailgate, hatchback, trunk lid or the like. The anti-chucking device 10 includes a wedge 12 and a cooperating receiver 14.

The receiver 14 includes a bracket 16 that holds a first stopper 18, a second stopper 20 and a pop-up mechanism, generally designated by reference numeral 22. More specifically, the first stopper 18 and the second stopper 20 define a throat 24 between there with the popup mechanism 22 positioned in the throat.

The wedge 12 may be made from plastic, such as glass fiber reinforced polyamide, or other appropriate material. The first stopper 18 and the second stopper 20 may be made from a resilient polymer material such as polyurethane or the like.

The first stopper 18 includes a first face 26. The second stopper 20 includes a second face 28. The first face 26 and the second face 28 are opposed and define sidewalls of the throat 24. As should be further appreciated the throat 24 includes a first end 30 that is open to receive the wedge 12 and a second end 32 is closed by the bracket 16. The first face 26 and the second face 28 converge toward the second end 32 of the throat 24.

The wedge 12 includes a third face 34, a fourth face 36 and a terminal end 38. In the illustrated embodiment, the third face 34 and the fourth face 36 converge toward the terminal end 38.

As best illustrated in FIGS. 3 and 3*a*, the pop-up mechanism 22 includes a housing or body 40 and a cooperating cover 42. In addition, the pop-up mechanism 22 includes a plunger 44 that is biased by a spring 46 that seats in the body 40. The cover 42 and body 40 junction together to protect the spring 46 from dirt and dust accumulation.

The plunger 44 includes a proximal end 48, a distal end 50 and a retaining ring 52 between the proximal end and the distal end. The spring 46 engages the retaining ring 52.

As further illustrated in FIGS. 3 and 3*a*, the cover 42 includes a plunger opening 56. The distal end 50 of the plunger has a first diameter D1, the plunger opening 56 has a second diameter D2 and the retaining ring 52 has a third diameter D3 where D1<D2<D3. As a result, it should be appreciated that when fully assembled, the plunger 44 is captured within the body 40 and cover 42 by engagement of the retaining ring 52 with the margin of the cover around the plunger opening 56 while the distal end of the plunger passes freely through the plunger opening 56 so as to project from the cover 42.

As illustrated in FIG. 2, the pop-up mechanism 22 is mounted in the throat 24 on the portion of the bracket 16 that closes the second end 32 of the throat with the plunger 44 biased toward the first end 30. The pop-up mechanism 22 may be secured in this position on the bracket 16 by any appropriate means.

Reference is now made to FIGS. 4*a* and 4*b* illustrating the operation of the anti-chucking device 10. In the illustrated embodiment, the wedge 12 is secured to the closure 66 by means of the bracket 68 and cooperating fastener 70. In contrast, the receiver 14 is secured to the body panel 72 by means of the fastener 74.

When one closes the closure 66, the closure and the wedge 12 secured thereto swing toward the body panel 72 and the receiver 14 as I illustrated by action arrow B in FIG. 4*a*. As the closure 66 closes, the wedge 12 enters the throat 24 of the receiver 14 with the third face 34 juxtaposed to the first face 26 and the fourth face 36 juxtaposed to the second face 28 while the terminal end 38 of the wedge 12 engages the distal end 50 of the plunger 44. As the plunger 44 is depressed against the force of the spring 46 closure closing energy is dissipated. This allows the closure latch mechanism (not shown) to latch and secure the closure 66 in the closed position thereby eliminating any possible bounce back of the closure. Once the latching mechanism is latched, it should be appreciated that the biasing force of the spring 46 on the plunger 44 causes the distal end 50 of the plunger to remain in engagement with the terminal end 38 of the wedge 12 thereby improving NVH performance.

Consistent with the above description, a method is provided of improving the NVH performance and reducing the closing effort of a motor vehicle closure 66. That method may be broadly described as comprising the steps of (a) providing a wedge 12 on a free edge of a motor vehicle closure 66 and (b) receiving that wedge in a throat 24 of a receiver 14 defined between a first stopper 18 and a second stopper 20 while engaging a terminal end 38 of that wedge with a plunger 44 positioned in the throat and adapted to dissipate closing energy of the motor vehicle closure.

The method may further include the step of providing the throat 24 with a first end 30 and a second end 32 wherein the first end is opened to receive the wedge 12. Further, the method may include the step of providing the first stopper 18 with a first face 26 and the second stopper 20 with a second face 28 wherein the first face and the second face define opposing sides of the throat 24 and the first face and the second face converge toward the second end 32 of the throat. Still further, the method may include the step of providing the wedge 12 with a third face 34 and a fourth face 36 wherein the third face and the fourth face converge toward the terminal end 38 of the wedge. As should be appreciated, the throat 24 is of a complimentary size to receive the wedge 12 when the closure 66 is closed with the first face juxtaposed to the third face and the second face juxtaposed to the fourth face.

Advantageously, the plunger 44 is loaded or biased by the spring 46 to both dissipate closure closing energy when the closure 66 is slammed closed by an operator and also to resist noise vibration and rattling once the closure latch mechanism is secured by maintaining pressure against the terminal end 38 of the wedge 12. Since the spring loaded plunger 44 dissipates closure closing energy, the throat 24 may be sized slightly larger to more easily receive the wedge 12 thereby reducing closure closing effort. This is possible because the spring loaded plunger 44 provides the necessary closure closing energy dissipation to allow proper latch mechanism function. Advantageously, the spring loaded plunger 44 also insures proper and trouble-free opening of the closure 66 by insuring that the closure passes the actuation range of the latch.

The foregoing has been presented for purposes of illustration and description. It is not intended to be exhaustive or to limit the embodiments to the precise form disclosed.

Obvious modifications and variations are possible in light of the above teachings. All such modifications and variations are within the scope of the appended claims when interpreted in accordance with the breadth to which they are fairly, legally and equitably entitled.

What is claimed:

1. An anti-chucking device for a motor vehicle closure, comprising:

a wedge; and a receiver including (a) a first stopper and a second stopper defining a throat there between and (b) a pop-up mechanism in said throat wherein said pop-up mechanism includes a body and a cover, wherein said pop-up mechanism includes a plunger biased by a spring, said throat includes a first end and a second end, said receiver includes a bracket holding said first stopper, said second stopper and said pop-up mechanism, said first end of said throat is open to receive said wedge and said bracket closes said second end of said throat, said first stopper includes a first face and said second stopper includes a second face wherein said first face and said second face are opposed and define sidewalls of said throat between said first end and said second end, said first face and said second face converge toward said second end of said throat, said plunger is oriented in said throat and biased by said spring toward said first end and said plunger includes a proximal end, a distal end and a retaining ring between said proximal end and said distal end.

2. The anti-chucking device of claim 1, wherein said cover includes a plunger opening and said distal end of said plunger extends through said plunger opening.

3. The anti-chucking device of claim 2, wherein said distal end of said plunger has a first diameter D1, said plunger opening has a second diameter D2 and said retaining ring has a third diameter D3 where D1<D2<D3 whereby said plunger is captured by said body and said cover.

4. The anti-chucking device of claim 3, wherein said wedge includes a third face, a fourth face and a terminal end.

5. The anti-chucking device of claim 4, wherein said third face and said fourth face converge toward said terminal end.

6. The anti-chucking device of claim 5, wherein when said wedge is received in said receiver, said terminal end engages said plunger, said third face is juxtaposed to said first face and said fourth face is juxtaposed to said second face.

7. The anti-chucking device of claim 6, wherein said first stopper and said second stopper are made from a resilient polymer material.

* * * * *